US005170510A

United States Patent [19]

Nava

[11] Patent Number: 5,170,510

[45] Date of Patent: Dec. 15, 1992

[54] INTEGRAL MOTORCYCLIST HELMET PROVIDED WITH MEANS FOR PREVENTING FOGGING OF THE VISOR THEREOF

[76] Inventor: Pier L. Nava, Via Nazario Sauro, 3, Cornate D'Adda (Milano), Italy

[21] Appl. No.: 755,716

[22] Filed: Sep. 6, 1991

[30] Foreign Application Priority Data

Sep. 19, 1990 [IT] Italy ..... 21791/90[U]

[51] Int. Cl.[5] ..... A42B 3/02; A42C 5/04

[52] U.S. Cl. ..... 2/414; 2/424; 2/171.3; 2/171.4

[58] Field of Search ..... 2/424, 425, 410, 414, 2/6, 171.3, 10, 171.4, 171.7, 436, 437

[56] References Cited

U.S. PATENT DOCUMENTS 4,622,700 11/1986 Sundahl ..... 2/425
4,700,411 10/1987 Kawasaki et al. ..... 2/425
4,704,746 11/1987 Nava ..... 2/424
4,964,178 10/1990 Giancarlo et al. ..... 2/414
5,058,212 10/1991 Kamata ..... 2/424

*Primary Examiner*—Peter Nerbun
*Attorney, Agent, or Firm*—Panitch Schwarze Jacobs & Nadel

[57] ABSTRACT

There is described herein an integral motorcyclist helmet which is provided with means adapted to prevent fogging of the visor thereof.

The above means include substantially an air passage (6) provided inside the helmet, at the top edge of the opening thereof, and substantially defined by the opposed edges of a rigid material outer cap (A) and of a shock absorbing material inner cap (B). Passage (6), which is supplied with air entering through an air intake (8) located on the helmet chinpiece, is in communication with channels (5) provided on inner cap (B), which are terminated inside a vacuum collection chamber (2) from which air and humidity are drawn out of the helmet through openings (15) provided in outer cap (A).

8 Claims, 3 Drawing Sheets

INTEGRAL MOTORCYCLIST HELMET PROVIDED WITH MEANS FOR PREVENTING FOGGING OF THE VISOR THEREOF

This invention relates to an integral motorcyclist helmet, which is provided with means adapted to thoroughly prevent fogging of the visor thereof, which fogging is caused by humid and warm air generated by the user, while breathing.

As it is already known, the most important problems to be solved when designing an integral motorcyclist helmet, besides the ones inherent to the helmet safety, comprise providing an effective air circulation within the helmet, in order to obtain optimum ventilation conditions, to relieve the user from inconveniences during usage.

The Applicant has already devised and filed corresponding Patent Applications concerning integral motorcyclist helmets, wherein the unique features have solved the ventilation problem, concerning in particular the portion of the helmet covering the head of the user, with a particularly high ventilation efficiency. An example of the above solutions is provided by the helmets forming the subject of Italian Patents No. 1207562 and 1177288.

However it has been found that the above helmets, while providing technically valuable solutions, left unsolved the problem of air circulation or ventilation of the front portion of the helmet, in particular of the visor thereof, with an associated stagnation of humid and warm air generated by the user while breathing, which caused fogging of the visor, thereby hindering a clear vision, and thus reducing the motorcyclist riding safety .

There has now been devised, and it makes the subject of this invention, an integral helmet for a motorcyclist, substantially of the same kind as the ones forming the subject of the aforementioned Patents, which solves in a unique and inventive fashion the system of preventing fogging of the helmet visor, thereby providing an integral helmet wherein ventilation and air circulation are now complete.

The features as well as the advantages of the integral helmet of this invention will become apparent from the following detailed description of a non limiting embodiment thereof, made in reference to the attached Figures, wherein.

Figure 1:
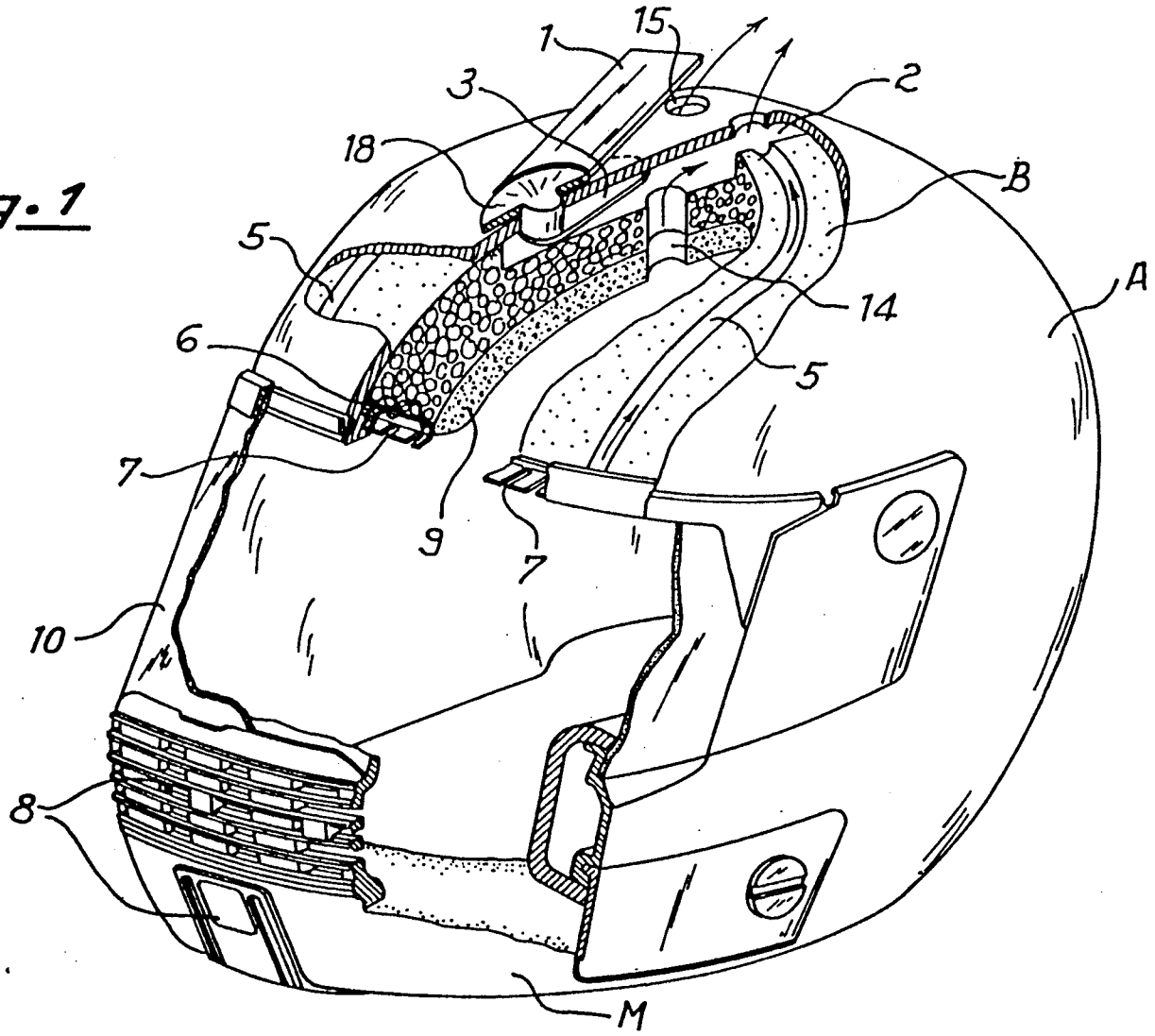
FIG. 1 is a partially cut away perspective view of the integral helmet of this invention.
Figure 2:
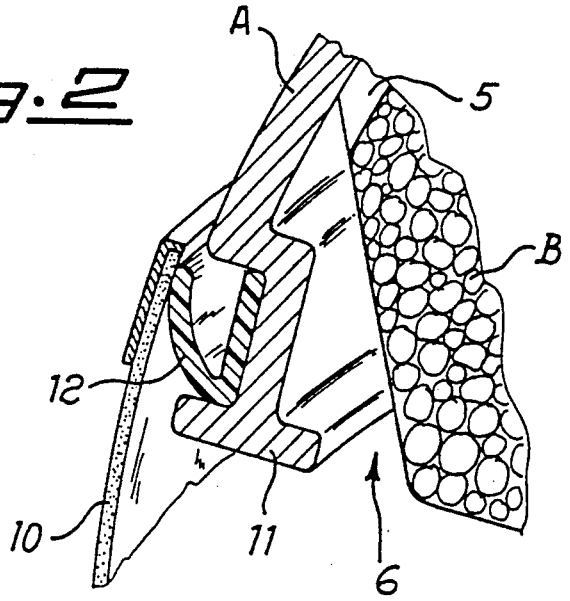
FIG. 2 is an enlarged scale schematic perspective view showing in particular how the air passage is provided in the upper portion of the helmet opening.
Figure 4B:
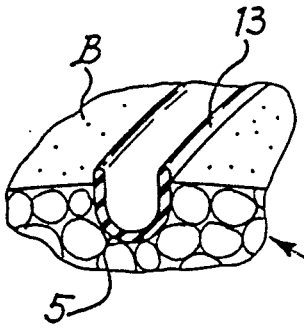
Figure 4A:
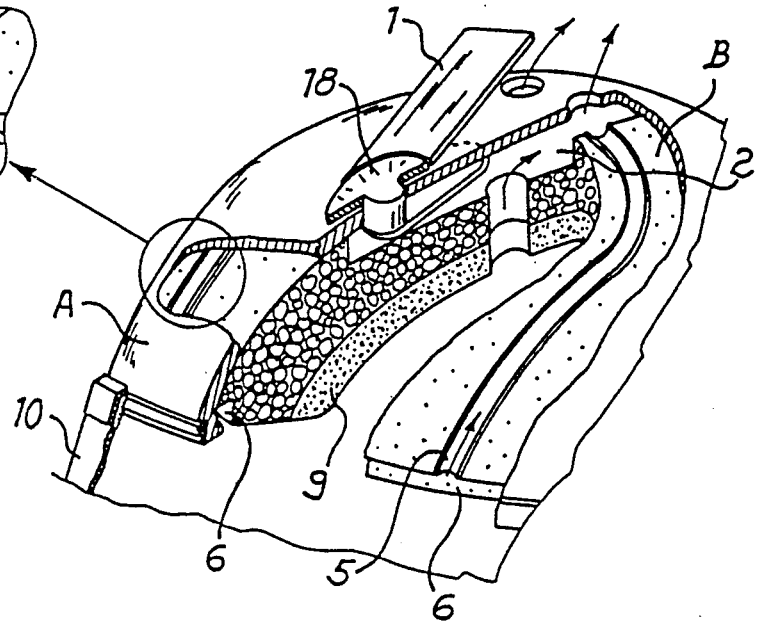
Figure 5:
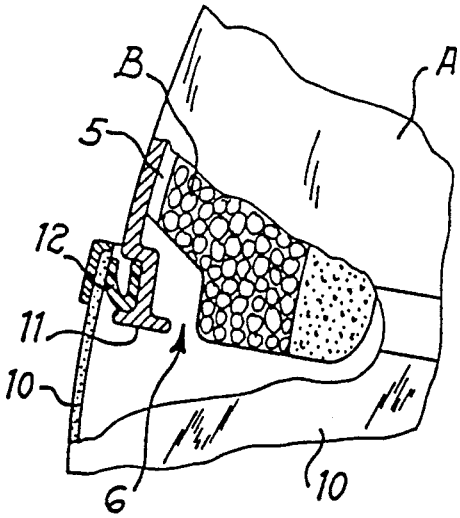
Figure 6:
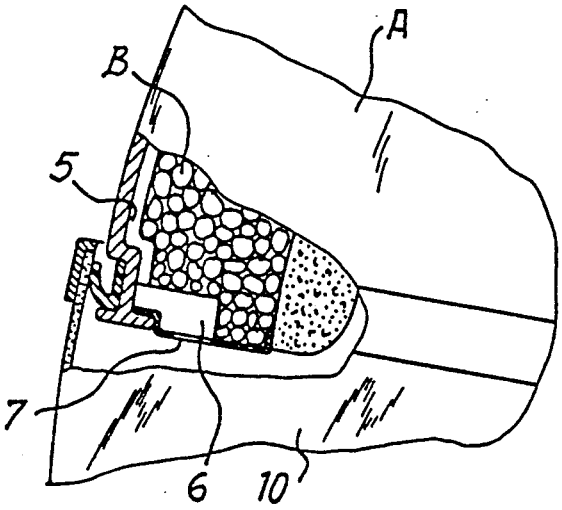

FIGS. 4*a* and 4*b* are a schematic perspective view showing in particular the aforementioned air passage, in a slightly modified embodiment thereof, with the various channels for exhausting air out from the helmet;

FIGS. 5 and 6 are two schematic cross-sectional views which show how the air passage is provided in the upper portion of the helmet opening, corresponding to FIGS. 2 and 1 respectively.

Referring now in particular to Figure the integral helmet of this invention includes, in the basic features 5 thereof, a rigid material outer cap A wherein there is provided an inner cap B made of shock absorbing material and bearing, on the lower side thereof, a lining or padding 9 of a known, air permeable material, which completes the structure of inner cap B.

The chinpiece M of the inventive helmet is provided in a known fashion with a front grating or air intake 8 through which air can flow inside the helmet while the vehicle is running in order to provide, according to the known solutions of the above mentioned Patents which are not specifically described again herein, ventilation for the area corresponding to the head of the user.

As it has been mentioned hereinabove, the problem of preventing fogging of visor 10, caused by the breath of the user himself remains still unsolved. This problem may be advantageously solved by means of the helmet of this invention, owing to the means provided therein, which will be described in particular in the following. Referring now also to FIGS. 2, 4*a*, 4*b*, 5 and 6, the means mentioned above include an air passage 6 defined by opposite edges, spaced a predetermined distance apart from each other, i.e. lower edge 11 shaped substantially as un upturned T, belonging to outer cap A, to which there is fastened the upper edge of visor 10, with gasket 12 sandwiched therebetween, and the opposite lower edge of inner cap B, in particular the lower edge of the portion thereof made of plastic material, for instance polystyrene, which lines the area corresponding substantially to the head of the user.

Passage 6 extends substantially over the whole width of visor 10, whereby the air flow entering the helmet through air intake 8 can flow freely towards said passage and therethrough, in the direction of the air exhausting channels which will be described in the following.

According to a particularly advantageous feature of the helmet of this invention, the air flow entering intake 8 and flowing through passage 6 takes, on the inner surface of visor 10, a substantially laminar flow pattern, which provides optimum conditions for aeration and ventilation thereof.

In the helmet shown in FIG. 1, passage 6 bears a grating 7 fastened thereto, which in the embodiment discussed herein has a substantially comb-like construction through the tines of which air flows towards the overlying air exhausting channels 5.

Advantageously, air intake grating 7 which extends over the whole width of passage 6, is directly fastened, for instance by sewing or welding, to padding 9, on one side thereof, or it is positioned in another known fashion, not described herein, without affecting at all outer cap A made of a rigid material.

According to a further particularly advantageous feature of the helmet of this invention, on the upper surface of cap B, and in particular on the upper surface of the plastic material portion, there is provided a number of air exhaust channels 5 whose upstream end is connected to air conveying channel or passage 6, and supplied with air therefrom from while, at the opposite nd thereof, they are in communication with a vacuum collection chamber 2 connected with the outside of the helmet, as it will be clarified in the following. Collection chamber 2 is provided within soft material cap B and is bound on the upper side thereof by cap A.

As it may be seen in particular in Figure in the exemplary embodiment shown herein each of the channels 5 comprises in practice a groove provided on inner cap B and each channel 5 is closed on the top side thereof substantially by engagement of the side edges thereof with the inner surface of cap A of rigid material. Therefore, air coming from conveying channel 6 will be able to flow freely along channels 5 all the way to collection chamber 2.

According to another advantageous feature of the helmet of this invention, as it is shown by the enlarged detail of FIGS. 4*a* and 4*b*, in order to improve and make tight the sealing along air exhausting channels 5, each of them is preferably provided with protruding longitudinal edges 13 comprising U-shaped sections of a resilient material, such as for instance rubber or the like, pressure-fitted within channels 5 and having a height slightly higher than that of said channels, in order to perfectly fit against the inner surface of the rigid material cap A.

However, it should be apparent that projections 13 mentioned above may be advantageously provided as a single piece with the upper portion of cap B, directly during molding thereof so that they will be of the same material as the cap, for instance polystyrene.

Figure 3:
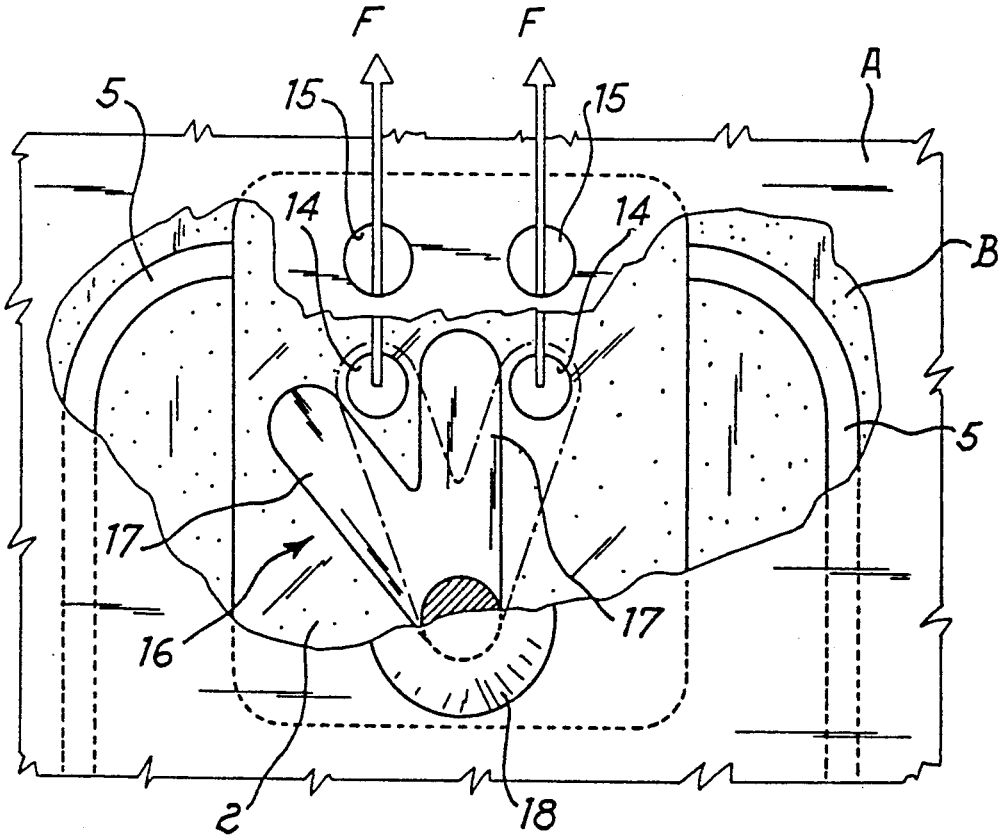
FIG. 3 is a schematic plan view which shows, in an enlarged scale, the area where air coming from the head area and from the visor area flows out from the helmet.

Referring now more particularly to FIG. 3, which shows schematically the circuit of the air flow, from conveying passage or channel 6 to vacuum chamber 2, through air exhausting channels 5, it may be seen that on the lower wall of vacuum chamber 2, already described in detail in the Patents mentioned above, and which is not described again in detail herein, there is provided a pair of openings 14 through which air arriving from the area of the head flows together into chamber 2 and may flow out therefrom through a further pair of openings 15 provided on outer cap A, being expelled to the outside of the helmet as shown schematically by arrows F of FIG. 3. As it should be apparent from the above Figure, the pair of openings 15 is slightly offset relative to the pair of openings 14 and through them there is exhausted to the outside of the helmet the air arriving through channels 5, from the portion of the helmet in the area of the visor.

According to a further inventive feature of the helmet of this invention, on the lower wall of vacuum chamber 2 there is mounted an interceptor valve shown in general at 16 which, in the simplified embodiment discussed herein, is substantially V-shaped so that each side 17 thereof may provide a partial or total opening or closing of openings 14, for ejecting the air coming from the area of the head in the helmet, when that is needed, for instance in summer. In this way, by means of the helmet of this invention, air coming from the area of visor 10 exits in any case from the helmet through openings 15, and such an action is enhanced through the actuation of valve 16 which partially or totally closes openings 14. Actuation of valve 16 is performed by means of a knob 18, shown schematically, whose portion providing a displacement of valve 16 is located outside the helmet, and fastened on a pivoting shaft projecting through cap A. It is shaped in such a way as to be aerodynamically integrated with a depression drawing member 1, in that it lies in the plane thereof.

FIGS. 4*a* and 4*b* are a further schematic showing of the means mentioned above, and in particular it is shown therein that passage 6 is not provided with grating 7, whereby the helmet construction is more cost effective.

The embodiment now discussed is the one corresponding to that shown in FIGS. 2 and 5, still in a schematic fashion, while in FIG. 6 passage 6 is provided substantially in the same way as in FIG. 1.

What has been described above shows quite apparently the advantages of the helmet of this invention which, owing to the above described visor air circulation and ventilation means, makes it possible to obtain a quick and effective defogging which can take place even within few yards of vehicle ride, when it starts again for instance after a stop at a traffic light, or after frequent stops in a traffic jam.

It should eventually be apparent that variations and/or modifications may be made to the integral motorcyclist helmet of this invention, without exceeding the scope of protection thereof.

I claim:

1. An integral motorcyclist helmet substantially comprising an outer cap (A) of rigid material having an inner surface and an outer surface, an inner cap (B) of a soft material fastened to the inner surface of the outer cap, the inner cap having an inner surface and an outer surface, an air permeable lining (9) provided on the inner surface of the inner cap, an opening formed within the outer cap and inner cap of the helmet for receiving a helmet visor (10) and a helmet chinpiece (M) located at a lower portion of the opening, wherein at an upper edge of the opening where the helmet visor (10) is mounted, there is provided on an inner surface of the visor, an air passage (6) for which air is fed from outside the helmet through at least one air intake (8) provided on the helmet chinpiece (M), said passage (6) communicating with a number of channels (5) for exhausting air from an area proximate the visor (10), provided on the outer surface of the soft material inner cap (B), an upstream end of the channels communicate with said passage (6), while an opposite end of the channels joins a vacuum collection chamber (2) located in a top area of the helmet in the soft material inner cap (B) and bound, on the outer side thereof, by the rigid material outer cap (A) which is provided with air exhaust openings 15, on the outside of the helmet, both for air coming from the area proximate the visor (10) and for air coming from a user's head, which flow together into the chamber (2) through at least one opening (14) provided on a bottom portion of the chamber (2).

2. The integral helmet of claim 1, wherein each of the air exhaust channels (5) is closed on the top thereof by the inner surface of the outer cap (A) contacting edges of said channels.

3. The integral helmet of claim 1 wherein each of the air exhaust channels (5) has projecting edges (13) extending beyond the channels (5) which provide a pressure contact against the inner surface of the outer cap (A), to seal said channels (5).

4. The integral helmet of claim 2, wherein at openings (14) of the chamber (2) for exhaust air coming from the head area, there is provided a valve (16) for controlling the degree of the opening of said openings (14), to enable a complete closure thereof, thereby increasing the amount of air that, after flowing in through the air intake (8), is exhausted through openings (15) of the outer cap (A).

5. The integral helmet of claim 4, wherein said valve has a number of substantially diverging arms (17) equal to the number of openings (14) of the chamber, said valve being rotated through the action of a knob (18) which is located outside the helmet.

6. The integral helmet of claim 1, wherein in passages (6) for air coming from air intake (8) provided on the helmet chinpiece, there is mounted a grating (7) having openings adapted to enable the air to be conveyed towards exhaust channels (5).

7. The integral helmet of claim 6, wherein the passage (6) and the grating (7) extend substantially over the whole width of visor (10).

8. The integral helmet of claim 6, wherein the air intake grating (7) is made of a substantially comb-like construction and is directly fastened onto the padding (9) of inner cap (B).

* * * * *